US008612103B2

(12) United States Patent
Nicholson et al.

(10) Patent No.: US 8,612,103 B2
(45) Date of Patent: Dec. 17, 2013

(54) IMPLEMENT ANGLE CORRECTION SYSTEM AND ASSOCIATED LOADER

(71) Applicant: Caterpillar Inc., Peoria, IL (US)

(72) Inventors: Christian Nicholson, Cary, NC (US); Todd R. Farmer, Apex, NC (US); Brian F. Taggart, Angier, NC (US); Mark A. Sporer, Simpsonville, SC (US); Luka G. Korzeniowski, Apex, NC (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/891,726

(22) Filed: May 10, 2013

(65) Prior Publication Data

US 2013/0275012 A1 Oct. 17, 2013

Related U.S. Application Data

(63) Continuation of application No. 12/642,120, filed on Dec. 18, 2009, now Pat. No. 8,463,508.

(51) Int. Cl.
*A01B 67/00* (2006.01)
*G06F 19/00* (2011.01)

(52) U.S. Cl.
USPC ..... 701/50; 172/4.5

(58) Field of Classification Search
USPC ..... 701/50, 49, 1; 700/272; 172/3, 4.5; 180/53.4
See application file for complete search history.

(56) References Cited

U.S. PATENT DOCUMENTS

| | | | | |
|---|---|---|---|---|
| 4,266,909 | A | | 5/1981 | Langenfeld et al. |
| 4,375,344 | A | | 3/1983 | Baum et al. |
| 4,923,362 | A | | 5/1990 | Fryk |
| 5,083,894 | A | | 1/1992 | Ikari et al. |
| 5,188,502 | A | | 2/1993 | Tonsor et al. |
| 5,234,312 | A | | 8/1993 | Hirose |
| 5,356,259 | A | | 10/1994 | Hanamoto et al. |
| 5,499,684 | A | * | 3/1996 | Stratton ..... 172/4.5 |
| 5,598,648 | A | | 2/1997 | Moriya et al. |
| 5,704,429 | A | | 1/1998 | Lee et al. |
| 5,768,810 | A | | 6/1998 | Ahn |
| 5,782,018 | A | | 7/1998 | Tozawa et al. |
| 5,826,666 | A | | 10/1998 | Tozawa et al. |
| 5,865,512 | A | * | 2/1999 | Meiser et al. ..... 303/139 |
| 6,047,228 | A | | 4/2000 | Stone et al. |
| 6,109,858 | A | | 8/2000 | Deneve et al. |
| 6,115,660 | A | | 9/2000 | Berger et al. |
| 6,140,787 | A | | 10/2000 | Lokhorst et al. |
| 6,205,687 | B1 | | 3/2001 | Rocke |

(Continued)

FOREIGN PATENT DOCUMENTS

EP 0 900 887 A1 3/1998

*Primary Examiner* — Tan Q Nguyen
(74) *Attorney, Agent, or Firm* — Finnegan, Henderson, Farabow, Garret & Dunner LLP

(57) ABSTRACT

A system for correcting an angle of an implement coupled to a loader is disclosed. The system comprises a controller that is configured to calculate a first angle correction signal based at least upon an engine speed signal and an operator interface actuation signal, the operator interface actuation signal commanding movement of a lift arm on a loader; calculate a second angle correction signal based at least upon a coupler angle signal; transmit the first and second angle correction signals to change the angle of a coupler configured to couple an implement to the lift arm; and temporarily disable transmission of the second angle correction signal.

20 Claims, 2 Drawing Sheets

(56) References Cited

U.S. PATENT DOCUMENTS

| | | | |
|---|---|---|---|
| 6,233,511 | B1 | 5/2001 | Berger et al. |
| 6,234,254 | B1 | 5/2001 | Dietz et al. |
| 6,246,939 | B1 | 6/2001 | Nozawa |
| 6,618,659 | B1 | 9/2003 | Berger et al. |
| 6,691,437 | B1 | 2/2004 | Yost et al. |
| 7,140,830 | B2 | 11/2006 | Berger et al. |
| 7,530,185 | B2 | 5/2009 | Trifunovic |
| 7,881,845 | B2 | 2/2011 | Nichols |
| 8,091,256 | B2 | 1/2012 | Piekutowski et al. |
| 2008/0040006 | A1* | 2/2008 | Sjogren et al. ..... 701/49 |
| 2009/0082930 | A1 | 3/2009 | Peters |
| 2009/0159302 | A1 | 6/2009 | Koch et al. |
| 2011/0091308 | A1 | 4/2011 | Nichols |

* cited by examiner

IMPLEMENT ANGLE CORRECTION SYSTEM AND ASSOCIATED LOADER

This is a continuation of application Ser. No. 12/642,120, filed Dec. 18, 2009, U.S. Pat. No. 8,463,508 the disclosure of which is incorporated herein by reference.

TECHNICAL FIELD

A system for correcting an angle of an implement coupled to a loader is disclosed. The system includes multiple subsystems governed by a controller.

BACKGROUND

Maintaining control over a load being carried by an implement coupled to a loader is important to help maximize worksite productivity. For instance, without sufficient load control, dirt or debris being carried by a bucket coupled to a loader may spill out of the bucket, thereby necessitating rework; similarly, without sufficient load control, material stacked on a pallet being carried by a fork coupled to a loader may fall off the pallet, also necessitating rework. Maintaining control over the angle of an implement coupled to a loader contributes significantly to maintaining control of a load being carried by the implement. However, the angle of such an implement may vary along the range of travel of the implement due to the kinematics of the system carrying the implement and/or due to slight drifts in the positions of the hydraulic cylinders helping to support the implement. Accordingly, systems for correcting such angle variations are desirable.

U.S. Pat. No. 7,140,830 B2 to Berger et al. discloses an electronic control system for skid steer loader controls. Specifically, the Berger et al. system provides a complex variety of modes, features, and options for controlling implement position, including an automatic implement self-leveling feature. The automatic implement self-leveling feature includes a return-to-dig mode and a horizon referencing mode. However, these modes in the Berger et al. system each rely largely upon multiple position sensors for information about implement position.

SUMMARY

A system for correcting an angle of an implement coupled to a loader is disclosed. The system includes a controller configured to receive a signal indicative of the speed of an engine on a loader and to receive a signal indicative of an actuation of an operator interface on the loader. The operator interface actuation signal commands movement of a lift arm on the loader. The controller is further configured to calculate an angle correction signal based at least upon the engine speed signal and the operator interface actuation signal and to transmit the angle correction signal to change an angle of a coupler configured to couple an implement to the lift arm.

A loader is disclosed that includes an engine system, an operator interface, a lift arm, an implement, a coupler configured to couple the implement to the lift arm, and a controller. The controller is configured to receive a signal indicative of the speed of an engine in the engine system and to receive a signal indicative of an actuation of the operator interface. The operator interface actuation signal commands movement of the lift arm. The controller is further configured to calculate an angle correction signal based at least upon the engine speed signal and the operator interface actuation signal, and to transmit the angle correction signal to change an angle of the coupler.

A controller-implemented method for correcting an angle of an implement coupled to a loader is disclosed. The method includes receiving a signal indicative of the speed of an engine on a loader and receiving a signal indicative of an actuation of an operator interface on the loader. The operator interface actuation signal commands movement of a lift arm on the loader. The method further includes calculating an angle correction signal based at least upon the engine speed signal and the operator interface actuation signal, and transmitting the angle correction signal to change an angle of an implement coupled to the lift arm.

DETAILED DESCRIPTION

Figure 1:
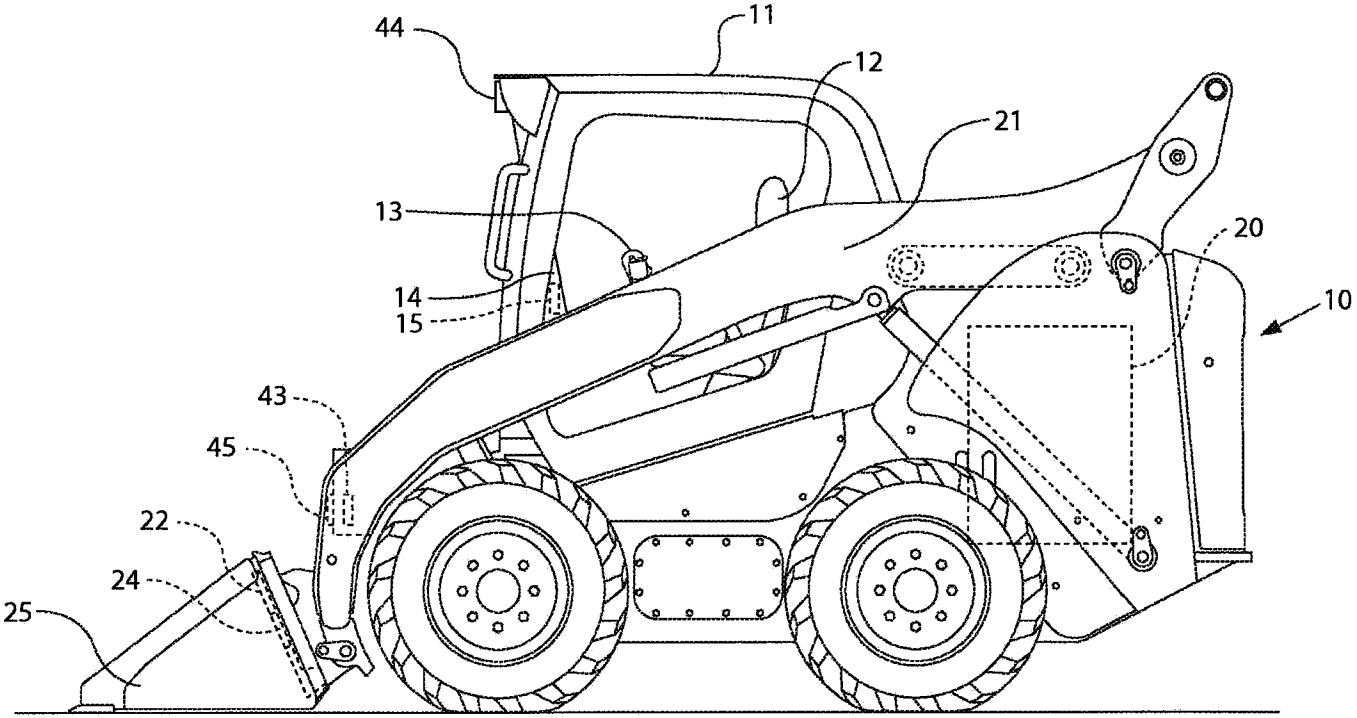
FIG. 1 is an elevational view of a loader according to an embodiment of the invention.

A loader according to an embodiment of the invention is shown broadly at reference numeral 10 in FIG. 1. The loader 10 includes a cab 11 housing an operator seat 12, an operator interface 13, a control panel 14, and a controller 15. The loader 10 further includes an engine system 20, a lift arm 21, a coupler 22 mounted on the lift arm 21, a coupler actuation system 23, and an angle sensor 24 mounted on the coupler 22. An implement 25 is attached to the coupler 22. The operator interface 13, the control panel 14, the engine system 20, the coupler actuation system 23, and the angle sensor 24 are each configured to communicate with the controller 15. The loader 10 is provided with sufficient electrical and electronic connectivity (not shown) to enable such communications. Though the illustrated loader 10 is a skid steer loader, the loader may be any other type of loader without departing from the scope of the invention. The controller 15 may be a single microprocessor or a plurality of microprocessors and could also include additional microchips for random access memory, storage, and other functions as necessary to enable the described functionalities. The coupler actuation system 23 is an electrohydraulic actuation system linking the controller 15 and the coupler 22. The angle sensor 24 of the disclosed embodiment is an inclinometer; however, any other type of angle sensor mountable on the coupler 22 may be employed. Similarly, though the illustrated implement 25 is a bucket, the implement may be any other type of implement attachable to the coupler 22.

Figure 2:
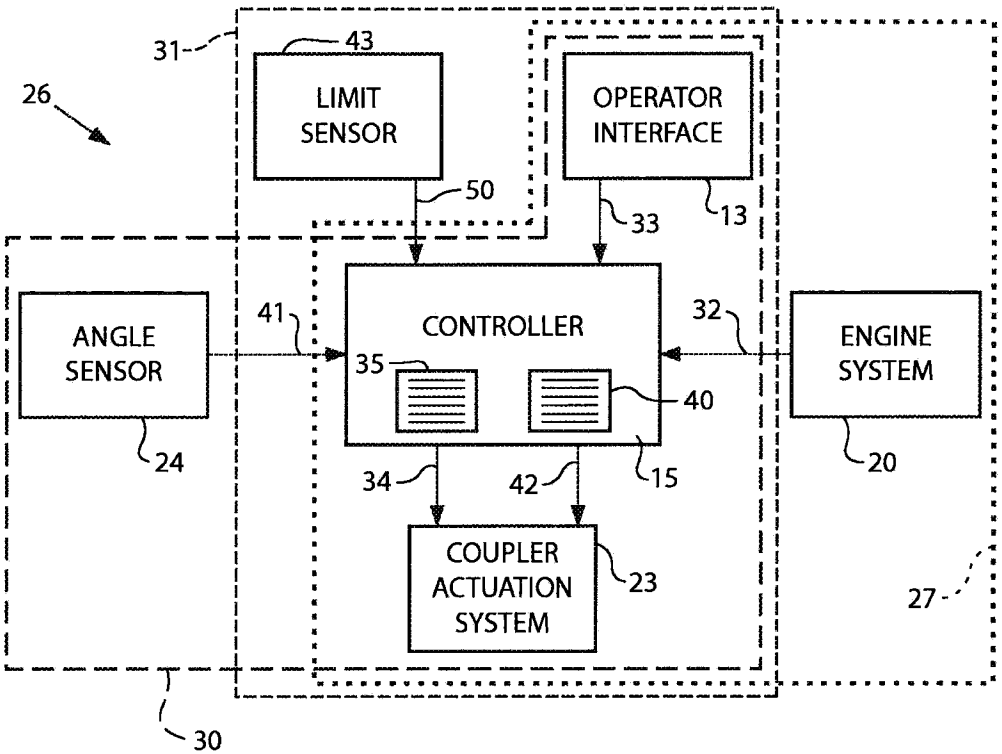
FIG. 2 is a schematic diagram of a system according to an embodiment of the invention.

Turning now to FIG. 2, a system 26 is disclosed for correcting an angle of the implement 25 is provided on the loader 10. The implement angle correction system 26 includes an open loop subsystem 27, a closed loop subsystem 30, and a limit subsystem 31. The open loop subsystem 27 includes the operator interface 13, the controller 15, the engine system 20, and the coupler actuation system 23. Specifically, in the open loop subsystem 27, the controller 15 is configured to receive a signal 32 indicative of the speed of the engine in the engine system 20 and a signal 33 indicative of an actuation of the operator interface 13. The operator interface actuation signal 33 is indicative of a command for the lift arm 21 to move at a speed associated with the degree of operator interface actuation. For instance, the operator interface 13 may be a joystick and commanded lift arm movement speed may vary directly with joystick displacement. The controller 15 then calculates a first angle correction signal, also referred to herein as an open loop correction signal 34, based at least upon the engine speed signal 32 and the operator interface actuation signal 33.

The controller 15 then transmits the open loop correction signal 34 to the coupler actuation system 23 to actuate the coupler 22 such that an angle of the implement 25 attached to the coupler 22 is changed.

The controller 15 calculates the open loop correction signal 34 by multiplying an initial correction calculation by an engine speed factor. The initial correction calculation is associated with the commanded lift arm movement speed, whereas the engine speed factor is associated with the engine speed indicated by the engine speed signal 32. These associations may be specified in maps, lookup tables, or similar data structures programmed into the controller 15. Specifically, upon receiving the operator interface actuation signal 33 and discerning a commanded lift arm movement speed from the operator interface actuation signal 33, the controller 15 accesses a first map 35 that associates lift arm movement speeds with initial correction calculations and utilizes the first map 35 to determine the initial correction calculation associated with the lift arm movement speed indicated by the operator interface actuation signal 33. In addition, also upon receiving the operator interface actuation signal 33, the controller 15 determines the engine speed indicated by the engine speed signal 32, accesses a second map 40 that associates engine speeds with engine speed factors, and utilizes the second map 40 to determine the engine speed factor associated with the engine speed indicated by the engine speed signal 32. Then, as mentioned above, the controller 15 multiplies the initial correction calculation by the engine speed factor to arrive at the open loop correction signal 34 to be transmitted to the coupler actuation system 23.

The closed loop subsystem 30 includes the operator interface 13, the controller 15, the coupler actuation system 23, and the angle sensor 24. Specifically, in the closed loop subsystem 30, the controller 15 receives a coupler angle signal 41 from the angle sensor 24 mounted on the coupler 22 and calculates a second angle correction signal, also referred to herein as a closed loop correction signal 42, based at least upon the coupler angle signal 41. More specifically, when the operator interface actuation signal 33 received by the controller 15 includes a command to start lift arm movement or to change the direction of lift arm movement from up to down or vice versa, the controller 15 stores the coupler angle most recently indicated by the coupler angle signal 41 as a target angle. The controller 15 then monitors the coupler angle signal 41 for deviations from the target angle. Then the controller 15 calculates the difference between the stored target angle and the actual angle continually indicated by the coupler angle signal 41 and, based upon the calculated difference between the angles, transmits the closed loop correction signal 42 to the coupler actuation system 23 such that the coupler 22 is actuated to the extent necessary for the actual angle indicated by the coupler angle signal 41 to match the target angle.

The limit subsystem 31 includes the operator interface 13, the controller 15, the coupler actuation system 23, a limit sensor 43, and upper and lower sensor triggers 44, 45 (FIG. 1). The limit sensor 43 is mounted on the lift arm 21 of the loader 10. The limit sensor 43 may be any type of presence or proximity sensor, while the sensor triggers 44, 45 may be metal strips or any other elements configured to trigger the limit sensor 43. The sensor triggers 44, 45 are positioned on the loader 10 such that the limit sensor 43 detects the presence of the triggers 44, 45 at the upper and lower limits of the travel of the lift arm 21, respectively. Specifically, when the limit sensor 43 detects the presence of one of the sensor triggers 44, 45, the limit sensor 43 transmits a limit signal 50 to the controller 15. The controller 15 is configured to receive the limit signal 50 and, upon receipt of the limit signal 50, to discontinue transmitting the open and closed loop correction signals 34, 42 to the coupler actuation system 23. Automatic actuation of the coupler 22 by the system 26 is thus discontinued when a limit of the travel of the lift arm 21 is reached, thereby helping to prevent overcorrection of the angle of the coupler 22, and by extension, overcorrection of the angle of the implement 25.

In addition, the controller 15 is configured to calculate a position of the lift arm 21 based at least upon the limit signal 50. The controller 15 calculates the position of the lift arm 21 by referring to the operator interface actuation signal 33 to determine which direction the operator interface actuation signal 33 most recently commanded the lift arm 21 to move. When the controller 15 receives the limit signal 50, if the operator interface actuation signal 33 indicates that the lift arm 21 was most recently commanded to move up, the controller 15 concludes that the limit sensor 43 has sensed the presence of the upper sensor trigger 44 and, by extension, that the lift arm 21 has reached the upper limit of lift arm travel. Similarly, if the operator interface actuation signal indicates that the lift arm 21 was most recently commanded to move down, the controller 15 concludes that the limit sensor 43 has sensed the presence of the lower sensor trigger 45 and, by extension, that the lift arm 21 has reached the lower limit of lift arm travel.

INDUSTRIAL APPLICABILITY

Under most conditions, the open loop subsystem 27, the closed loop subsystem 30, and the limit subsystem 31 are all continuously enabled while the implement angle correction system 26 is operating. The limit subsystem 31 affects the operation of both the open and closed loop subsystems 27, 30 as described above, i.e., by discontinuing the open and closed loop correction signals 34, 42 when the limit sensor 43 detects the presence of either the upper or lower sensor trigger 44, 45. The open loop subsystem 27 is generally configured to cause sudden, undampened corrections of the angle of the coupler 22. In contrast, the closed loop subsystem 30 is generally configured to cause gradual, dampened corrections of the angle of the coupler 22. The dampening of the response of the closed loop subsystem 30 is accomplished by the controller 15. Specifically, the controller 15 is configured to apply a low-pass filter to the coupler angle signal 41 in order to prevent the closed loop subsystem 30 from reacting to sudden and/or frequent phenomena such as machine vibration. Furthermore, the controller 15 is a proportional-integral controller configured to increase the amount of coupler angle correction over time as a given difference between the actual and target coupler angles persists. Accordingly, the open and closed loop subsystems 27, 30 generally complement one another, with the open loop subsystem 27 reacting suddenly to actuations of the operator interface 13 and the closed loop subsystem 30 reacting slowly to differences between the actual and target coupler angles indicated by the angle sensor 24.

However, in some situations the closed loop subsystem 30 is automatically temporarily disabled by the controller 15 while the open loop subsystem 27 continues to operate. For example, if the loader 10 accelerates rapidly either forward or backward, the angle sensor 24 may falsely detect a significant change in coupler angle. Thus, if the controller 15 concludes from signals received from wheel speed sensors (not shown) that such acceleration is occurring, the controller 15 temporarily disables the closed loop subsystem 30 in order to prevent the potentially erroneous coupler angle signal 41 from causing unnecessary changes to the coupler angle. By way of further example, if an operator actuates the operator interface 13 such that the coupler 22 suddenly tilts the implement 25 backward towards the loader 10 as a lift arm movement is commanded, the angle sensor 24 may generate an incorrect target angle. Thus, if the controller 15 concludes that such actuation of the operator interface 13 has occurred, the controller 15 temporarily disables the closed loop subsystem 30 in order to prevent an incorrect target angle from being generated.

The implement angle correction system 26 may be activated and deactivated by an operator as desired by manipulating a control switch (not shown) in the cab 11. In addition, an operator may override the system 26 by using the operator interface 13 or another operator control to manually command a change in the coupler angle during lift arm movement. Finally, as explained above, the system 26 operates only while lift arm movement is being commanded by actuation of the operator interface 13, as the open loop subsystem functions based on commanded lift arm speed and the closed loop subsystem functions based on a target angle stored when lift arm movement is commanded.

A system for correcting an angle of an implement coupled to a loader is disclosed. Many aspects of the disclosed embodiment may be varied without departing from the scope of the invention, which is delineated only by the following claims.

What is claimed is:

1. A system for correcting an angle of an implement coupled to a loader, the system comprising a controller configured to:

calculate a first angle correction signal based at least upon an engine speed signal and an operator interface actuation signal, the operator interface actuation signal commanding movement of a lift arm on a loader;

calculate a second angle correction signal based at east upon a coupler angle signal;

transmit the first and second angle correction signals to change the angle of a coupler configured to couple an implement to the lift arm; and temporarily disable transmission of the second angle correction signal.

2. The system of claim 1, wherein when transmission of the second angle correction signal is disabled, the first angle correction signal is transmitted to change the angle of the coupler configured to couple the implement to the lift arm.

3. The system of claim 1, wherein the controller temporarily disables transmission of the second angle correction signal when a rapid acceleration of the loader occurs.

4. The system of claim 1, wherein the controller temporarily disables transmission of the second angle correction signal when a sudden tilt of the implement occurs.

5. The system of claim 1, wherein the controller is further configured to set a target coupler angle upon receiving the operator interface actuation signal.

6. The system of claim 1, wherein the operator interface actuation signal is indicative of a speed at which the lift arm is commanded to move.

7. The system of claim 6, wherein the controller calculates the first angle correction signal by multiplying an initial correction calculation by an engine speed factor, the initial correction calculation being associated with the commanded lift arm movement speed and the engine speed factor being associated with the engine speed indicated by the engine speed signal.

8. The system of claim 1, wherein the controller is further configured to receive a signal indicating that a limit of the travel of the lift arm has been reached.

9. The system of claim 8, wherein the controller is further configured to calculate a position of the lift arm based at least upon the limit signal.

10. A loader, comprising:

an engine system;

an operator interface;

a lift arm;

an implement;

a coupler configured to couple the implement to the lift arm; and a controller configured to:

calculate a first angle correction signal based at least upon an engine speed signal and an operator interface actuation signal, the operator interface actuation signal commanding movement of a lift arm on a loader;

calculate a second angle correction signal based at least upon a coupler angle signal;

transmit the first and second angle correction signals to change the angle of a coupler configured to couple an implement to the lift arm; and temporarily disable transmission of the second angle correction signal.

11. The loader of claim 10, wherein when transmission of the second angle correction signal is disabled, the first angle correction signal is transmitted to change the angle of the coupler configured to couple the implement to the lift arm.

12. The loader of claim 10, wherein the controller temporarily disables transmission of the second angle correction signal when a rapid acceleration of the loader occurs.

13. The loader of claim 10, wherein the controller temporarily disables transmission of the second angle correction signal when a sudden tilt of the implement occurs.

14. The loader of claim 10, wherein the controller is further configured to set a target coupler angle upon receiving the operator interface actuation signal.

15. The loader of claim 10, wherein the operator interface actuation signal is indicative of a speed at which the lift arm is commanded to move.

16. The loader of claim 15, wherein the controller calculates the first angle correction signal by multiplying an initial correction calculation by an engine speed factor, the initial correction calculation being associated with the commanded lift arm movement speed and the engine speed factor being associated with the engine speed indicated by the engine speed signal.

17. The loader of claim 10, wherein the controller is further configured to receive a signal indicating that a limit of the travel of the lift arm has been reached.

18. A controller-implemented method for correcting an angle of an implement coupled to a loader, the method comprising:

receiving a signal indicative of the speed of an engine on a loader;

receiving a signal indicative of an actuation of an operator interface on the loader, the operator interface actuation signal commanding movement of a lift arm on the loader;

receiving a signal indicative of a coupler angle;

calculating a first angle correction signal based at least upon the engine speed signal and the operator interface actuation signal;

calculating a second angle correction signal based at least upon the signal indicative of a coupler angle;

transmitting the first and second angle correction signals to change an angle of an implement coupled to the lift arm; and temporarily disabling transmission of the second angle correction signal.

19. The method of claim 18, wherein transmission of the second angle correction signal is temporarily disabled when a rapid acceleration of the loader occurs.

20. The method of claim 18, wherein transmission of the second angle correction signal is temporarily disabled when a sudden tilt of the implement occurs.

* * * * *